US011485537B2

(12) United States Patent
Djokovic et al.

(10) Patent No.: US 11,485,537 B2
(45) **Date of Patent: *Nov. 1, 2022**

(54) CONTAINER HAVING MULTIPLE DISPLAY CONFIGURATIONS AND METHOD FOR FORMING SAME

(71) Applicant: WestRock Shared Services, LLC, Atlanta, GA (US)

(72) Inventors: Dejan Djokovic, Parker, CO (US); David G. Couture, Hoschton, GA (US); Kevin Simpkins, Cumming, GA (US)

(73) Assignee: WESTROCK SHARED SERVICES, LLC, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/099,388

(22) Filed: Nov. 16, 2020

(65) Prior Publication Data

US 2021/0070495 A1 Mar. 11, 2021

Related U.S. Application Data

(63) Continuation of application No. 16/033,469, filed on Jul. 12, 2018, now Pat. No. 10,836,532.

(60) Provisional application No. 62/532,435, filed on Jul. 14, 2017.

(51) Int. Cl.

| | |
|---|---|
| ***B65D 5/52*** | (2006.01) |
| ***B65D 5/54*** | (2006.01) |
| ***B65D 5/42*** | (2006.01) |
| ***B65D 5/02*** | (2006.01) |
| ***B65D 5/32*** | (2006.01) |

(52) U.S. Cl.

CPC ..... *B65D 5/52* (2013.01); *B65D 5/0227* (2013.01); *B65D 5/32* (2013.01); *B65D 5/4204* (2013.01); *B65D 5/5445* (2013.01); *B65D 5/5495* (2013.01)

(58) Field of Classification Search

CPC ..... B65D 5/52; B65D 5/5445; B65D 5/5495; B65D 5/32; B65D 5/4204

USPC ..... 206/736, 45.21

See application file for complete search history.

(56) References Cited

U.S. PATENT DOCUMENTS

| | | | |
|---|---|---|---|
| 8,376,141 | B2 | 2/2013 | Couture |
| 8,910,856 | B2 | 12/2014 | Sumpmann et al. |
| 9,555,919 | B2 | 1/2017 | Gessler, Jr. et al. |
| 10,472,124 | B2 | 11/2019 | Barton et al. |
| 10,836,532 | B2 * | 11/2020 | Djokovic ..... B65D 5/5495 |
| 2012/0234724 | A1 | 9/2012 | James et al. |
| 2013/0150224 | A1 | 6/2013 | DeCello et al. |

(Continued)

*Primary Examiner* — Steven A. Reynolds
(74) *Attorney, Agent, or Firm* — Neil G. Cohen

(57) ABSTRACT

A blank for forming a container is provided. The blank includes a top panel, a first and second side panels, and a bottom panel coupled together in series by a plurality of generally parallel fold lines, wherein the bottom panel includes a free side edge, the first side panel includes a first separation line, and the second side panel includes a second separation line. The blank also includes a first end flap and a second end flap extending from opposing side edges of the first side panel, and a third end flap and a fourth end flap extending from opposing side edges of the second side panel, wherein the second and fourth end flaps are configured for removal with the top panel after the container is formed and the first and second separation lines are separated.

12 Claims, 6 Drawing Sheets

(56) References Cited

U.S. PATENT DOCUMENTS

| | | | |
|---|---|---|---|
| 2014/0367308 | A1 | 12/2014 | James et al. |
| 2017/0267398 | A1 | 9/2017 | Couture |
| 2017/0361974 | A1 | 12/2017 | Capistrant et al. |

* cited by examiner

CONTAINER HAVING MULTIPLE DISPLAY CONFIGURATIONS AND METHOD FOR FORMING SAME

REFERENCE TO RELATED APPLICATION

This application is a continuation of U.S. patent application Ser. No. 16/033,469 filed on Jul. 12, 2018 which claims the benefit of priority under 35 U.S.C. § 119(e) of U.S. provisional application Ser. No. 62/532,435 filed on Jul. 14, 2017, which are both hereby incorporated by reference in their entirety.

BACKGROUND

The field of the disclosure relates generally to a container formed from a sheet of material and, more particularly, to a container that includes multiple display configurations.

At least some conventional containers for transporting, storing and/or displaying products include walls that are secured together to provide sufficient structural support to allow the stacking of the display containers. However, if the product in such containers is required to be removed and placed somewhere else, such as a retailer shelf, the removal process has to be done one piece at a time. Therefore, the removal process, especially at large retailers, is extremely time consuming. Accordingly, a container that enables product to be displayed in, or quickly removed from, the container is desired.

BRIEF DESCRIPTION

In one aspect, a blank for forming a container is provided. The blank includes a top panel, a first side panel, a bottom panel, and a second side panel coupled together in series by a plurality of generally parallel fold lines, wherein the bottom panel includes a free side edge, the first side panel includes a first separation line extending from proximate the free side edge to a diagonally opposite corner of the first side panel, and the second side panel includes a second separation line extending from proximate the free side edge to a diagonally opposite corner of the second side panel. The blank also includes a first end flap and a second end flap extending from opposing side edges of the first side panel, and a third end flap and a fourth end flap extending from opposing side edges of the second side panel, wherein the second and fourth end flaps are configured for removal with the top panel after the container is formed and the first and second separation lines are separated.

In another aspect, a container formed from a blank is provided. The container includes opposing top and bottom walls, the bottom wall including a free side edge, and opposing first and second side walls perpendicular to the opposing top and bottom walls, the first and second side walls including respective opposing first and second side edges, wherein the first side wall further includes a first separation line extending from proximate the free side edge to a diagonally opposite corner of the first side wall, and the second side wall further includes a second separation line extending from proximate the free side edge to a diagonally opposite corner of the second side wall. The container also includes opposing first and second end walls perpendicular to the opposing top and bottom walls and perpendicular to the opposing first and second walls. The second end wall includes a first end flap emanating from the first side edge of the first side wall and a third end flap emanating from the first side edge of the second side wall, the first end wall includes a second end flap emanating from the second side edge of the first side wall and a fourth end flap emanating from the second side edge of the second side wall, and the first end wall is removable with the top wall after the first and second separation lines are separated.

In another aspect, a method of converting a container into a product display configuration is provided. The container is formed from a blank and including opposing top and bottom walls. The opposing first and second side walls are perpendicular to the opposing top and bottom walls, and the opposing first and second end walls are perpendicular to the opposing top and bottom walls and perpendicular to the opposing first and second walls. The method includes separating the first side wall of the container along a first separation line, wherein the bottom wall includes a free side edge and the first separation line extends from proximate the free side edge to a diagonally opposite corner of the first side wall. The method also includes separating a second side wall of the container along a second separation line, wherein the second separation line extends from proximate the free side edge to a diagonally opposite corner of the second side wall, and wherein the first and second side walls include respective opposing first and second side edges. The method further includes removing a removable portion of the container from a base of the container, the removable portion including the top wall and the first end wall, wherein the second end wall includes a first end flap emanating from the first side edge of the first side wall and a third end flap emanating from the first side edge of the second side wall, the first end wall includes a second end flap emanating from the second side edge of the first side wall and a fourth end flap emanating from the second side edge of the second side wall, and the first end wall includes the second and fourth end flaps.

DETAILED DESCRIPTION

Figure 1:
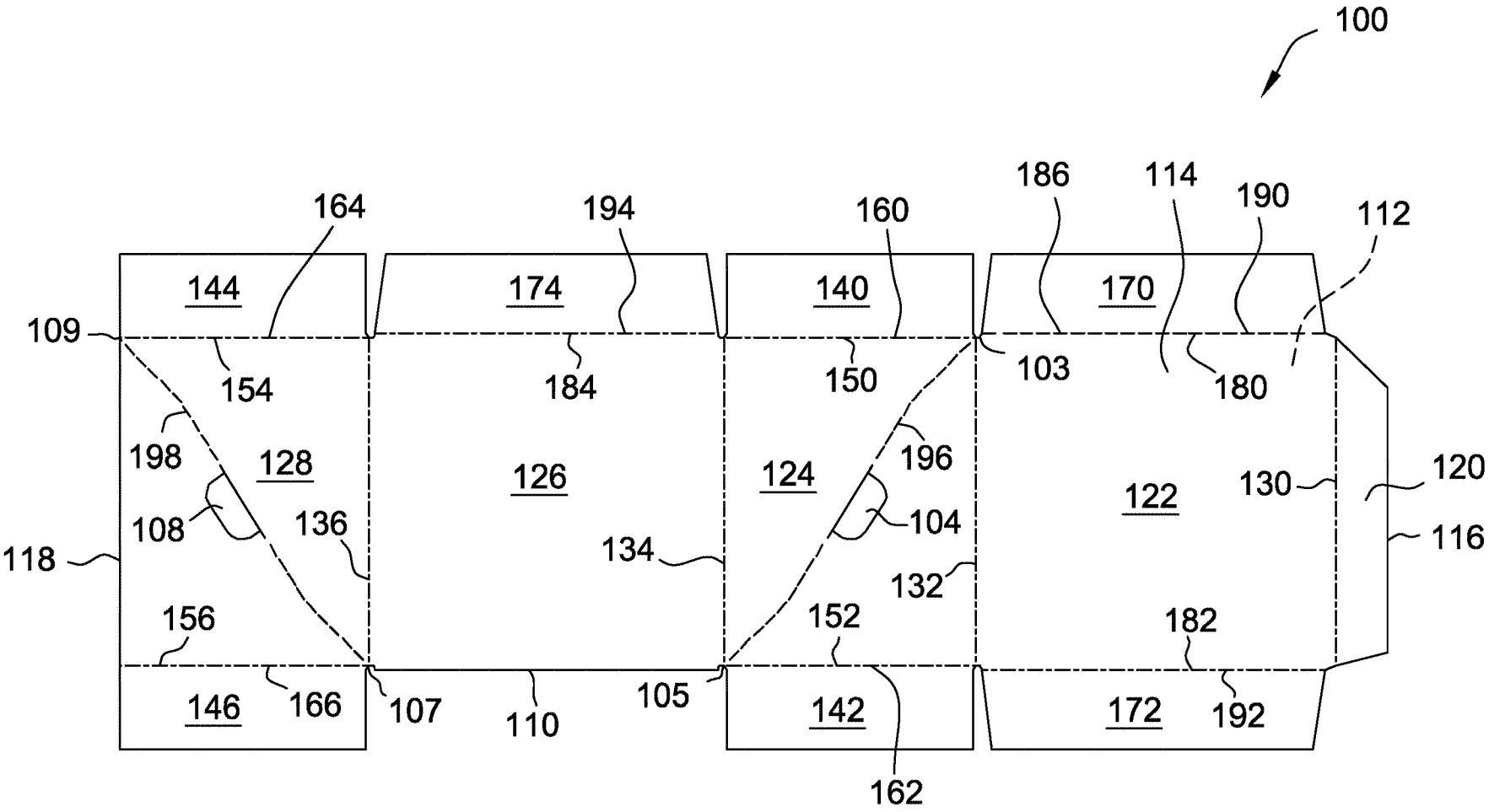
FIG. 1 is a top plan view of a blank of sheet material for constructing a container according to an embodiment of the present disclosure.

The following detailed description illustrates the disclosure by way of example and not by way of limitation. The description clearly enables one skilled in the art to make and uses the disclosure, describes several embodiments, adaptations, variations, alternatives, and use of the disclosure, including what is presently believed to be the best mode of carrying out the disclosure.

The present disclosure provides a stackable shipping, collapsible, and display container, as well as a method for constructing and disassembling the container. In one embodiment, the container includes at least one removable that includes a top panel. In some embodiments, the at least one removable section is defined by separation lines, such as perforation lines, in opposing side panels. While the separation lines are intact, the side panels facilitate securing the top section of the container to a base of the container. In certain embodiments, the container also includes an end wall that may be selectively oriented as a front or back wall. The container may define an open display area while providing sufficient strength to allow stacking, shipping, and display of a plurality of products. The container is constructed from a blank of sheet material. The blank is formed by a machine that imparts fold lines, cut lines, and other lines of weakness to the blank. In one embodiment, the blank is fabricated from a paperboard material. The blank, however, may be fabricated using any suitable material, and therefore is not limited to a specific type of material. In alternative embodiments, the blank is fabricated using cardboard, plastic, fiberboard, paperboard, foamboard, corrugated paper, and/or any suitable material known to those skilled in the art and guided by the teachings herein provided.

In the example embodiment, the blank used to make the container may include at least one marking thereon including, without limitation, indicia that communicates the product, a manufacturer of the product and/or a seller of the product. For example, the marking may include printed text that indicates a product's name and briefly describes the product, logos and/or trademarks that indicate a manufacturer and/or seller of the product, and/or designs and/or ornamentation that attract attention. "Printing," "printed," and/or any other form of "print" as used herein may include, but is not limited to including, ink jet printing, laser printing, screen printing, giclee, pen and ink, painting, offset lithography, flexography, relief print, rotogravure, dye transfer, and/or any suitable printing technique known to those skilled in the art and guided by the teachings herein provided. In another embodiment, the blank is devoid of markings, such as, without limitation, indicia that communicates the product, a manufacturer of the product and/or a seller of the product. Furthermore, the container may have any suitable size, shape and/or configuration, i.e., any suitable number of sides having any suitable size, shape and/or configuration as described and/or illustrated herein. In one embodiment, the container includes a shape that provides functionality, such as a shape that facilitates packaging a plurality of product, a shape that facilitates packaging a plurality of containers, a shape that facilitates transporting the container, and/or a shape that facilitates stacking and/or arrangement of a plurality of containers.

After the container reaches a destination (e.g., a retailer), the container may be converted into a display tray by removing the removable section and positioning the container within a display area visible to consumers to facilitate displaying the product contained within the container. The display tray defines a display area for displaying the product. It will be apparent to those skilled in the art and guided by the teachings herein provided that the disclosure is likewise applicable to any suitable storage, shipping and/or display container including, without limitation, a carton, a tray, or a box. In an alternative embodiment, after the removable section is removed, the display tray may be slid forward relative to the product. Once the display tray is slid forward (e.g., removed from the display area), the product is displayed without the display tray.

Figure 2:
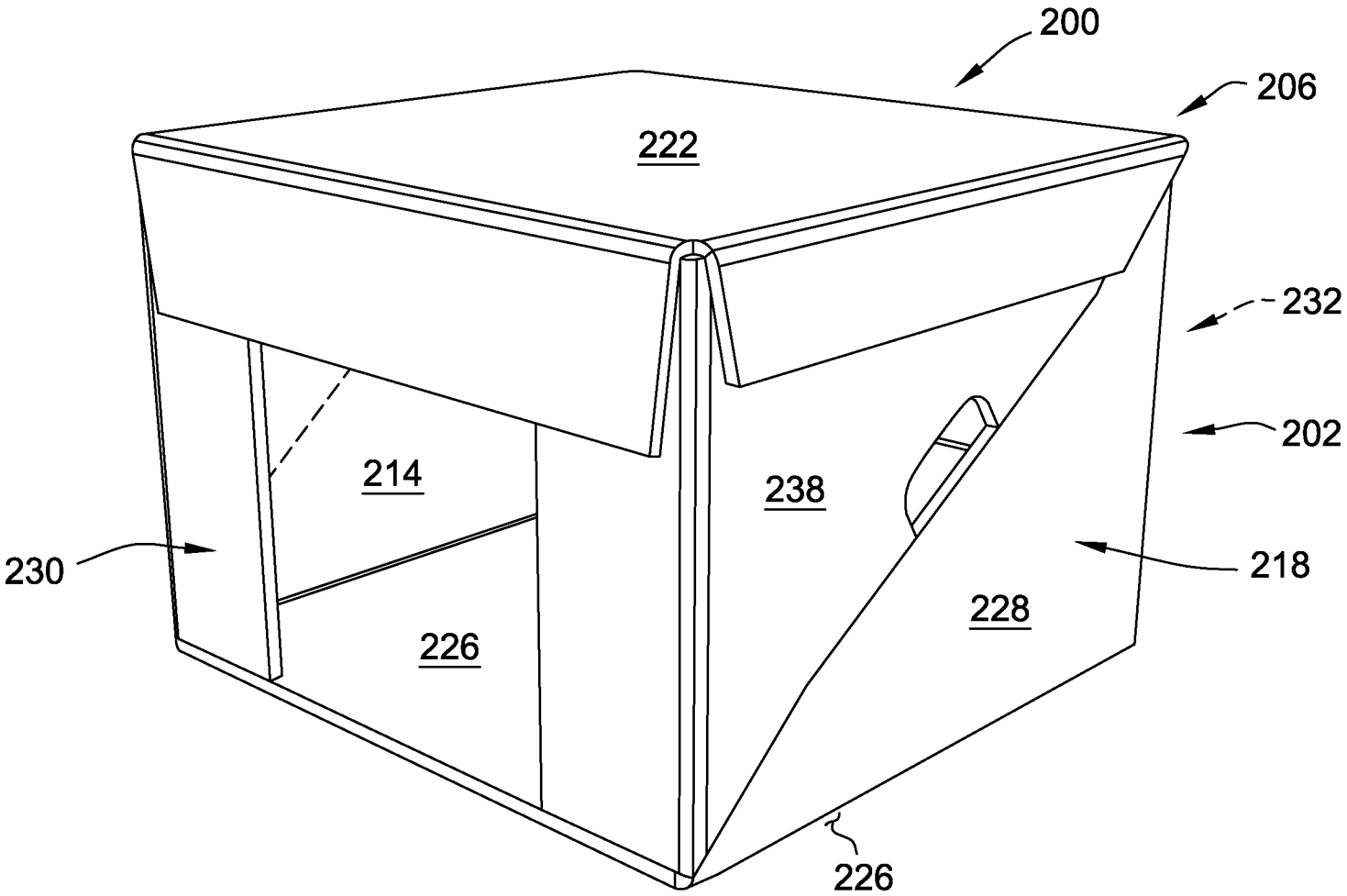
FIG. 2 is a perspective view of a container formed from the blank shown in FIG. 1 in a shipping configuration.
Figure 3:
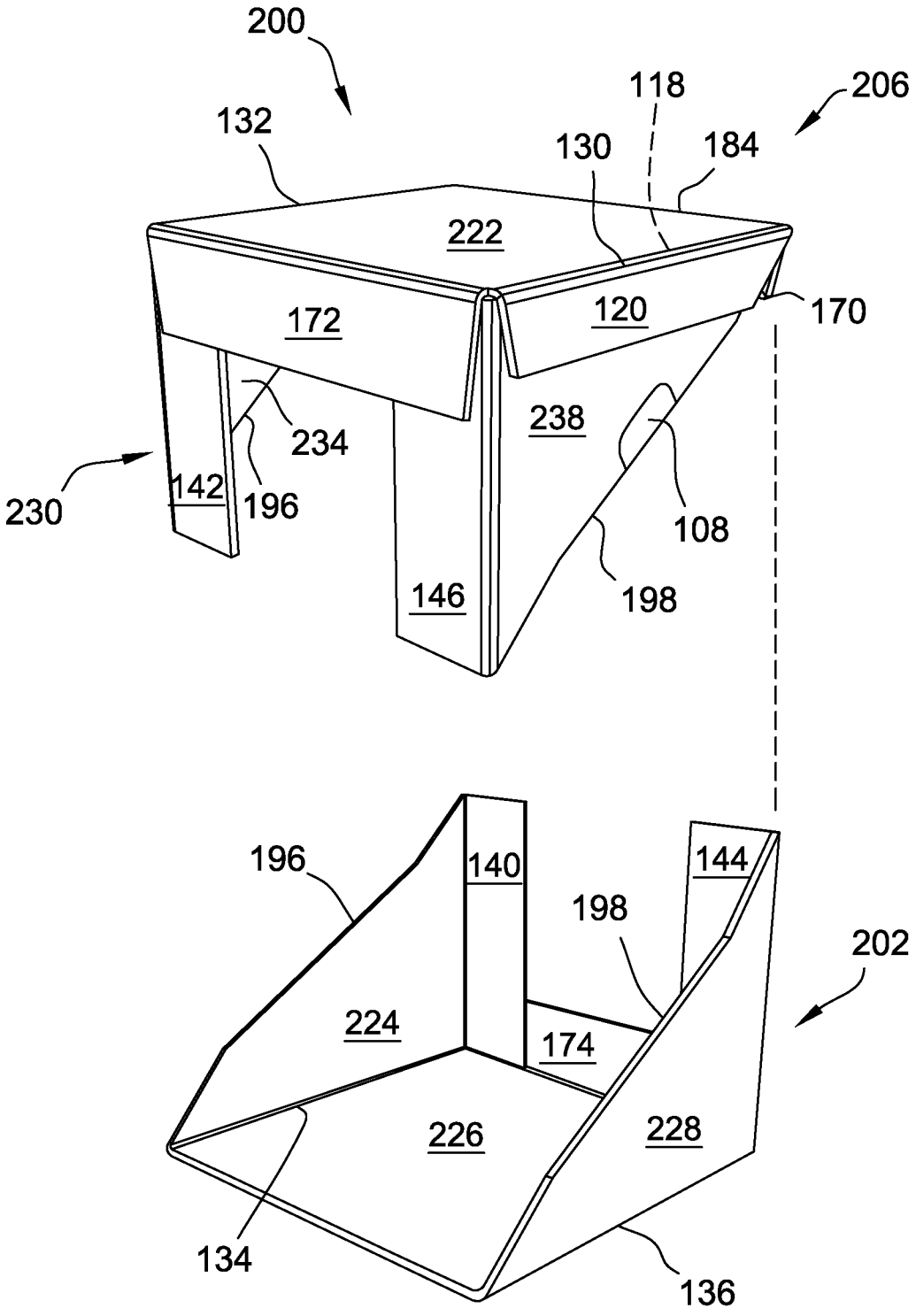
FIG. 3 is a perspective view of the container shown in FIG. 2 separated into a base and a removable section.

Referring now to the drawings, and more specifically to FIGS. 1, 2, and 3, although as described above a container may have any suitable size, shape and/or configuration, FIGS. 1, 2, and 3 illustrate the construction or formation of one embodiment of a container from a blank. Specifically, FIG. 1 is a top plan view of one embodiment of a blank 100 of sheet material. FIGS. 2 and 3 are perspective views of one embodiment of a container 200 formed from blank 100 shown in FIG. 1.

Referring to FIG. 1, blank 100 has a first or interior surface 112 and an opposing second or exterior surface 114. Further, blank 100 defines a leading edge 116 and an opposing trailing edge 118. In the example embodiment, blank 100 has a corrugation direction generally parallel to a length of blank 100 defined between leading edge 116 and trailing edge 118, facilitating an increased stacking strength of container 200 in the shipping configuration shown in FIG. 2. In alternative embodiments, blank 100 has a corrugation direction generally perpendicular to a length of blank 100 defined between leading edge 116 and trailing edge 118, facilitating an increased stacking strength of container 200 in an alternative shipping orientation rotated 90 degrees from the configuration shown in FIG. 2, having second end wall 232 oriented on the bottom of container 200. Alternatively, the corrugation direction is any suitable direction.

In the example embodiment, blank 100 includes, from leading edge 116 to trailing edge 118, a glue panel 120, a top panel 122, a first side panel 124, a bottom panel 126, and a second side panel 128 coupled together in series along preformed, generally parallel fold lines 130, 132, 134, and 136, respectively. More specifically, top panel 122 extends from glue panel 120 along fold line 130, first side panel 124 extends from top panel 122 along fold line 132, bottom panel 126 extends from first side panel 124 along fold line 134, and second side panel 128 extends from bottom panel 126 along fold line 136. Fold lines 130, 132, 134, and 136, as well as other fold lines described herein, may include any suitable line of weakening and/or line of separation known to those skilled in the art and guided by the teachings herein provided. In alternative embodiments, glue panel 120 extends from second side panel 128 and defines trailing edge 118.

As shown in FIG. 1, in the example embodiment a first end flap 140 and a second end flap 142 are coupled to first side panel 124 along preformed, generally parallel fold lines 150 and 152, respectively. Specifically, first end flap 140 extends from a first side edge 160 of first side panel 124 along fold line 150. Second end flap 142 extends from an opposing second side edge 162 of first side panel 124 along fold line 152. A third end flap 144 and a fourth end flap 146 are coupled to second side panel 128 along preformed, generally parallel fold lines 154 and 156, respectively. Specifically, third end flap 144 extends from a first side edge 164 of second side panel 128 along fold line 154. Fourth end flap 146 extends from an opposing second side edge 166 of second side panel 128 along fold line 156.

A fifth end flap 170 and a sixth end flap 172 are coupled to top panel 122 along preformed, generally parallel fold lines 180 and 182, respectively. Specifically, fifth end flap 170 extends from a first side edge 190 of top panel 122 along fold line 180. In an alternative embodiment, fifth end flap 170 extends from first side edge of top panel 122 along a third separation line 186. Third separation line 186 extends along first side edge 190 of top panel 122. Sixth end flap 172 extends from an opposing second side edge 192 of top panel 122 along fold line 182. A seventh end flap 174 is coupled to bottom panel 126 along preformed fold line 184. Specifically, seventh end flap 174 extends from a first side edge 194 of bottom panel 126 along fold line 184.

Further, bottom panel 126 defines a second side edge 110 opposite first side edge 194. In the example embodiment, second side edge 110 of bottom panel 126 is a free edge, with no end flap or other panel extending therefrom. In some embodiments, second, or free, side edge 110 facilitates display and removal of products from container 200 in a product display configuration 600 (shown in FIG. 6) with a clean front edge (for example, no detritus from removal of a perforated flap) along a bottom wall 226. In other embodiments, second, or free, side edge 110 facilitates pulling a base of container 200 out from under products contained therein to form product display configurations 400 and 500 (shown in FIGS. 4 and 5, respectively).

In the example embodiment, fold lines 150, 152, 154, 156, 180, 182, and 184 and second side edge 110 are generally perpendicular to fold lines 130, 132, 134, and 136.

In the example embodiment, first side panel 124 includes a first cutout 104 and a first separation line 196. As used herein, the term "separation line" refers to any preformed line, such as but not limited to score lines, perforation lines, or other lines of separation, along which a material of blank 100 is configured to have a relatively decreased resistance to tearing or separation. Once any preformed line is broken, each edge of the preformed line provides a clean front edge without perforation to enhance aesthetics of the display area. That is, each edge is clean-cut manufactured and aesthetically pleasing. First separation line 196 extends from a first end 103 to a second end 105. First end 103 is proximate to second, or free, side edge 110 of adjacent bottom panel 126, and proximate to an intersection of first side edge 160 of first side panel 124 and fold line 132. Second end 105 is at the diagonally opposite corner of first side panel 124, relative to first end 103. More specifically, second end 105 is proximate to an intersection of second side edge 162 of first side panel 124 and fold line 134, such that first side panel 124 is separable into two portions generally diagonally along a first separation line 196. In alternative embodiments, first end 103 and second end 105 are positioned in any suitable fashion that enables container 200 to function as described herein. First cutout 104 is coupled along a mid-portion of first separation line 196.

Second side panel 128 includes a second cutout 108 and a second separation line 198. Second separation line 198 extends from a first end 107 to a second end 109. First end 107 is proximate to second, or free, side edge 110 of adjacent bottom panel 126, and proximate to an intersection of second side edge 166 of second side panel 128 and fold line 136. Second end 109 is at the diagonally opposite corner of second side panel 128, relative to first end 107. More specifically, second end 109 is proximate to an intersection of first side edge 164 of second side panel 128 and trailing edge 118, such that second side panel 128 is separable into two portions generally diagonally along second separation line 198. In alternative embodiments, first end 107 and second end 109 are positioned in any suitable fashion that enables container 200 to function as described herein. Second cutout 108 is coupled along a mid-portion of second separation line 198. First cutout 104 and second cutout 108 may have any suitable size, shape, and/or configuration that enables container 200 to function as described herein. In alternative embodiments, blank 100 does not include cutouts 104 and/or 108.

FIG. 2 illustrates container 200 formed from blank 100 in a shipping configuration. To form container 200, first and second side panels 124 and 128, top panel 122, and glue panel 120 are rotated about respective fold lines 134, 136, 132, and 130 toward interior surface 112. More specifically, first side panel 124 is rotated about fold line 134 toward interior surface 112 to form a first side wall 214. First side wall 214 includes cutout 104 and separation line 196. Further, second side panel 128 is rotated about fold line 136 toward interior surface 112 and glue panel 120 is rotated along fold line 130 and coupled to second side panel 128, such as using an adhesive, to form a second side wall 218 parallel to first side wall 214. Second side wall 218 includes second cutout 108 and second separation line 198. Bottom panel 126 forms a bottom wall 226 of container 200, and top panel 122 forms a top wall 222 of container 200 parallel to bottom wall 226.

Moreover, second, fourth, and sixth end flaps 142, 146, and 172 are rotated to form a first end wall 230. More specifically, second and fourth end flaps 142 and 146 are rotated about respective fold lines 152 and 156 toward interior surface 112 of respective first and second side panels 124 and 128. Second and fourth end flaps 142 and 146 may be rotated before, concurrently, and/or after first and second side panels 124 and 128, top panel 122, and glue panel 120 are rotated. After rotation, second and fourth end flaps 142 and 146 extend from second side edge 110 of bottom panel 126 to second side edge 192 of top panel 122, that is, from bottom wall 226 to top wall 222, facilitating first end wall 230 providing stacking strength to container 200 proximate to the corners of container 200, for example during shipping and handling of container 200. In the example embodiment, sixth end flap 172 is rotated about fold line 182 toward interior surface 112 of top panel 122. After rotation, sixth end flap 172 is coupled to second and fourth end flaps 142 and 146, such as using an adhesive.

Similarly, first, third, fifth, and seven end flaps 140, 144, 170, and 174 are rotated to form a second end wall 232. More specifically, first and third end flaps 140 and 144 are rotated about respective fold lines 150 and 154 toward interior surface 112 of respective first and second side panels 124 and 128. First and third end flaps 140 and 144 may be rotated before, concurrently, and/or after first and second side panels 124 and 128, top panel 122, and glue panel 120 are rotated. After rotation, first and third end flaps 140 and 144 extend from first side edge 194 of bottom panel 126 to first side edge 190 of top panel 122, that is, from bottom wall 226 to top wall 222, enabling second end wall 232 to provide stacking strength to container 200 proximate to the corners of container 200, for example during shipping and handling of container 200. In some embodiments, blank 100 has a corrugation direction generally parallel to a length of blank 100 as described above, such that the corrugation direction runs vertically in end flaps 140, 142, 144, and 146 when container 200 is in the shipping configuration of FIG. 2, further facilitating increased stacking strength. In the example embodiment, fifth and seventh end flaps 170 and 174 are rotated about respective fold lines 180 and 184 toward interior surface 112 of respective top and bottom panels 122 and 126. After rotation, fifth and seventh end flaps 170 and 174 are each coupled to first and third end flaps 140 and 144, such as by using adhesive. First and second end walls 230 and 232 are parallel to each other and perpendicular to side walls 214, 218 and top and bottom walls 222, 226.

Furthermore, container 200 is separable into a base 202 and a removable section 206, as illustrated in FIG. 3. More specifically, removable section 206 is separable along separation lines 196 and 198. Base 202 includes bottom wall 226, a first side wall 224 and second side wall 228 formed from portions of side walls 214 and 218 below separation lines 196 and 198, respectively, and a portion of second end wall 232 that includes first, third, and seventh end flaps 140, 144, and 174. Removable section 206 includes top wall 222, a first side wall 234 and a second side wall 238 formed from portions of side walls 214 and 218 above separation lines 196 and 198, respectively, all of first end wall 230 including second, fourth and sixth end flaps 142, 144, and 172, and a portion of second end wall 232 that includes fifth end flap 170. Fifth end flap 170 removable with removable section 206 avoids a requirement for a perforation or other separation line along first side edge 190 of top panel 122, thereby simplifying removal of removable section 206. In some embodiments, in order to increase stability of base 202, fifth end flap 170 is not removable with removable section 206 and a perforation or other separation line, such as third separation line 186, along first side edge 190 of top panel 122 is included. First side wall 234 of removable section 206 includes cutout 104, and second side wall 238 of removable section 206 includes second cutout 108 and glue panel 120. In alternative embodiments, first and second side walls 224, 228 of base 202, respectively, may include first and second cutouts 104 and 108.

Figure 4A:
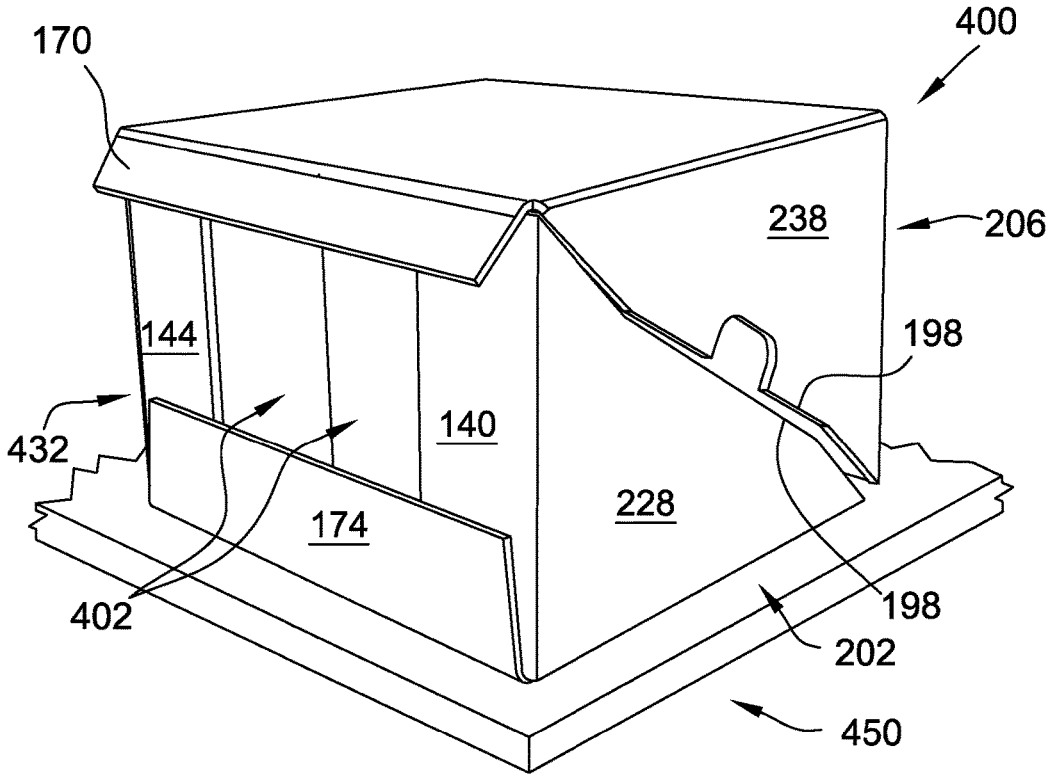
FIG. 4A is a perspective view of the container shown in FIG. 2 in a display configuration.
Figure 4B:
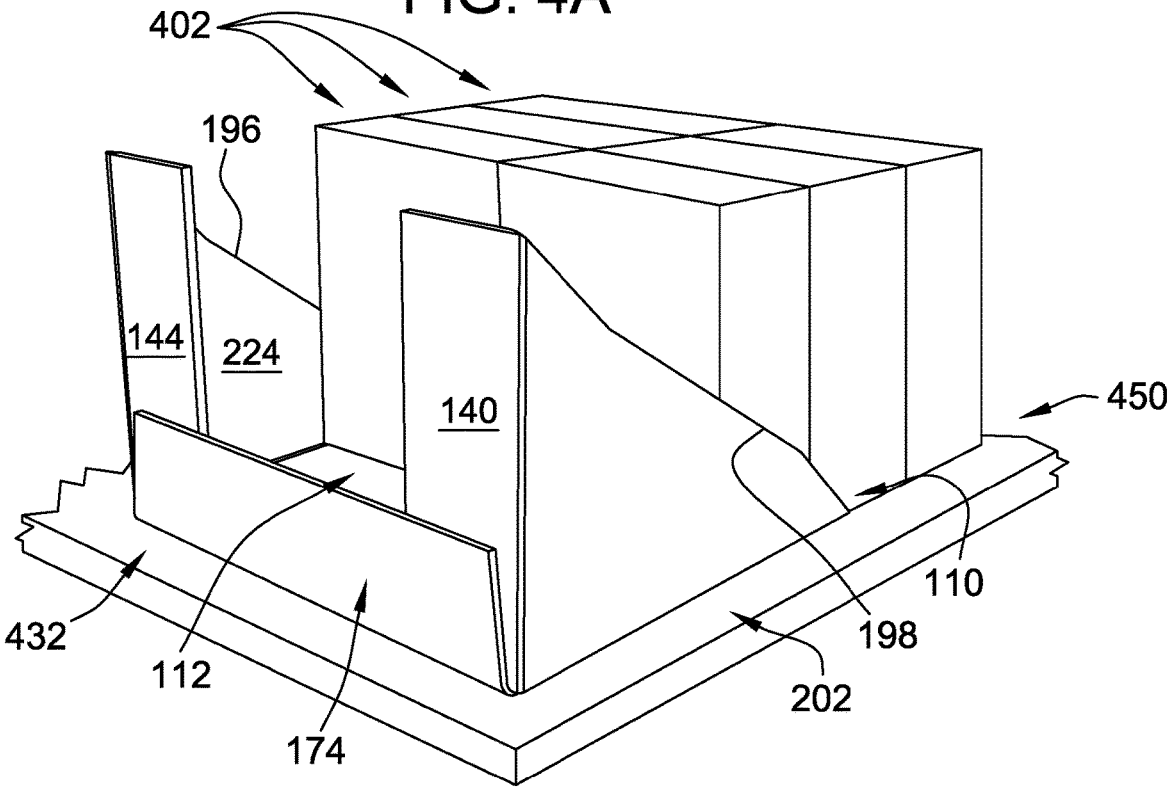
FIG. 4B is a perspective view of the container in the display configuration shown in FIG. 4A being used to form a standalone product display.

FIGS. 4A and 4B illustrate an example product display configuration 400 for container 200 that facilitates a stand-alone display of products 402 initially contained in container 200. In this embodiment, container 200 is oriented such that a front wall 432 is formed by second end wall 232 (shown in FIG. 2). To open container 200, fifth end flap 170 is lifted and detached from first and third end flaps 140 and 144, such as by manually breaking an adhesive bond. Subsequently, removable section 206 is detached from base 202 by separating or breaking each of first and second side panels 124 and 128 along respective separation lines 196 and 198. In one embodiment, separation lines 196 and 198 may be broken by pushing inward on third and fourth side walls 214 and 218 (shown in FIG. 2) above respective separation lines 196, 198. In another embodiment, separation lines 196 and 198 may be broken by using cutouts 104 and 108 (shown in FIG. 1). For example, cutouts 104 and 108 may be grasped and lifted while holding down on seventh end flap 174 of base 202. Additionally or alternatively, fifth end flap 170 coupled to removable section 206 provides a lever for separation of separation lines 196 and 198. Alternatively, separation lines 196 and 198 may be separated in any suitable fashion. After separation lines 196 and 198 are separated, removable section 206 is lifted from base 202.

After separation of separation lines 196 and 198, base 202 is pulled out from under products 402, leaving products 402 in a stand-alone display (i.e., without any portion of container 200) on a display area 450, such as a shelf. Second side edge 110 of bottom wall 226, initially formed as a clean free edge of blank 100, slides underneath products 402 with correspondingly reduced interference as compared to an edge having a flap or torn separation line. In one embodiment, seventh end flap 174 is used as a lever to disengage base 202 from products 402. Products 402 are held in place in any suitable fashion (e.g., by a hand of a user, a stopper, or the like), and base 202 is pulled out from under products 402, for example, by the user's other hand pulling seventh end flap 174. In another embodiment, first and/or third end flaps 140 and 144 may be used as a lever to disengage base 202 from products 402. Removal of removable section 206 requires separating only two separation lines, and second, or free, side edge 110 facilitates sliding of bottom wall 226 easily from under products 402, facilitating quick and easy conversion of container 200 into standalone display of products 402. In other words, all of the perimeter edges of top panel 122, first side panel 124, bottom panel 126, and second side panel 128 are substantially devoid of separation lines, that is, are free of separation lines except where first and second separation lines 196 and 198 intersect with the respective corners of first and second side panels 124 and 128. Moreover, the faces of each of top panel 122, bottom panel 126, and first through sixth end flaps 140, 142, 144, 146, 170, 172, and 174 are devoid of separation lines extending therethrough. In some embodiments, the absence of separation lines at these locations increases a strength of container 200 in the shipping configuration relative to similar display-convertible containers having additional lines of separation in these areas.

Figure 5A:
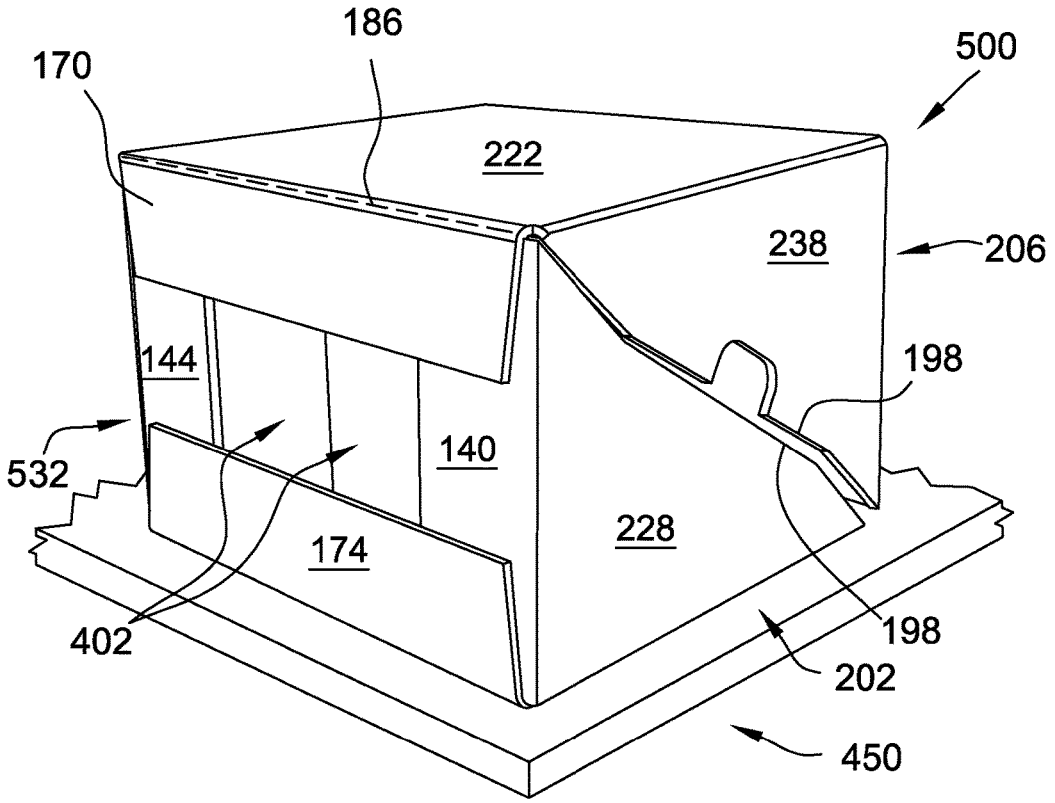
FIG. 5A is a perspective view of the container shown in FIG. 2 in an alternative display configuration.
Figure 5B:
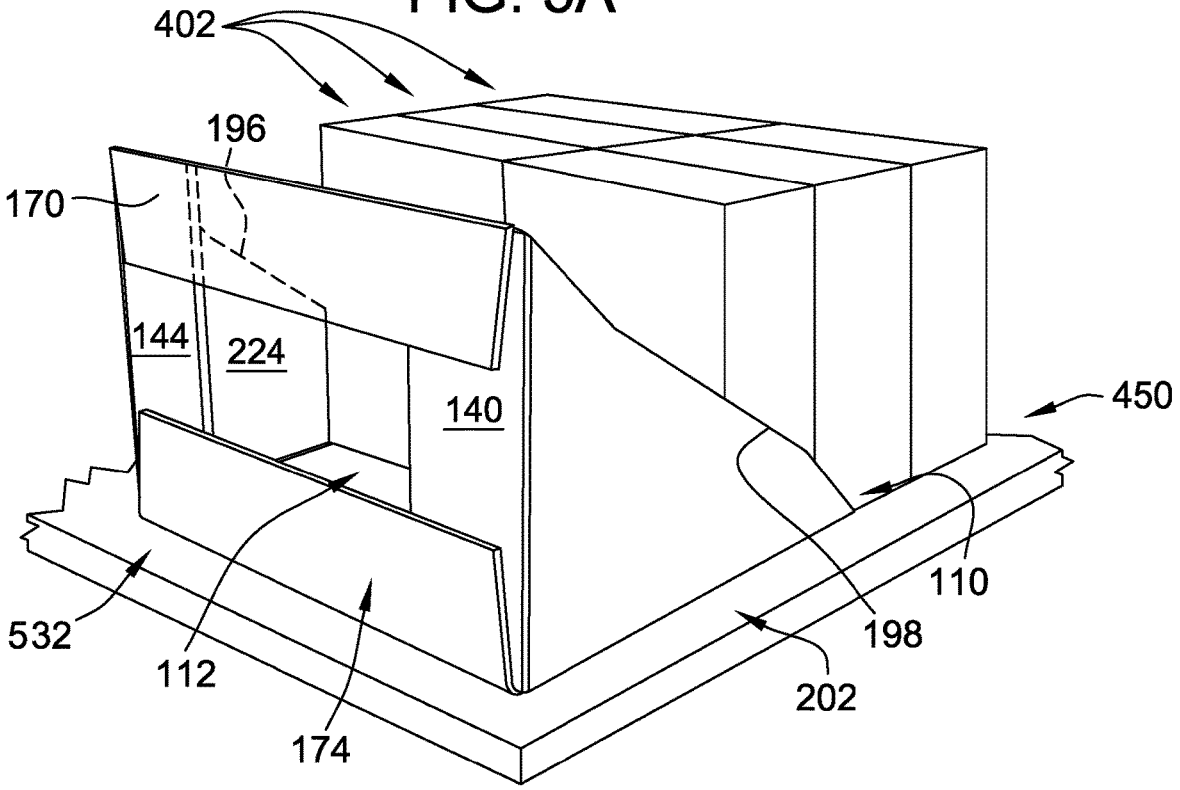
FIG. 5B is a perspective view of the container in the alternative display configuration shown in FIG. 5A being used to form a standalone product display.

FIGS. 5A and 5B illustrate an example product display configuration 500 for container 200 that facilitates a stand-alone display of products 402 initially contained in container 200. In this embodiment, container 200 is oriented such that a front wall 532 is formed by second end wall 232 (shown in FIG. 2). To open container 200, removable section 206 is detached from base 202 by separating or breaking each of first and second side panels 124 and 128 along respective separation lines 196 and 198. In one embodiment, separation lines 196 and 198 may be broken by pushing inward on third and fourth side walls 214 and 218 (shown in FIG. 2) above respective separation lines 196, 198. In another embodiment, separation lines 196 and 198 may be broken by using cutouts 104 and 108 (shown in FIG. 1). For example, cutouts 104 and 108 may be grasped and lifted while holding down on seventh end flap 174 of base 202. Additionally or alternatively, third separation line 186 may be broken by pushing inward on top wall 222. Third separation line 186 extends along first side edge 190 such that top wall 222 is separated from fifth end flap 170. In alternative embodiments, third separation line 186 is positioned in any suitable fashion that enables container 200 to function as described herein. Alternatively, third separation line 186 may be separated in any suitable fashion. Separation lines 196, 198, and 186 may be broken in any suitable order. After separation lines 196, 198, and 186 are separated, removable section 206 is lifted from base 202 and fifth end flap 170 remains attached to first and third end flaps 140 and 144 increasing stability of base 202.

In the example embodiment, after separation of separation lines 196, 198, and 186, base 202 is pulled out from under products 402, leaving products 402 in a stand-alone display (i.e., without any portion of container 200) on a display area 450, such as a shelf. Second side edge 110 of bottom wall 226, initially formed as a clean free edge of blank 100, slides underneath products 402 with correspondingly reduced interference as compared to an edge having a flap or torn separation line. In one embodiment, seventh end flap 174 is used as a lever to disengage base 202 from products 402. In another embodiment, fifth end flap 170 is used as a lever to disengage base 202 from products 402. In yet another embodiment, fifth end flap 170 and seventh end flap 174 are used as levers to disengage base 202 from products 402. In another embodiment, first and/or third end flaps 140 and 144 may be used as a lever to disengage base 202 from products 402. In yet another embodiment, any end flap and/or end flaps may be used as levers in any suitable fashion to disengage base 202 from products 402. Products 402 are held in place in any suitable fashion (e.g., by a hand of a user, a stopper, or the like), and base 202 is pulled out from under products 402, for example, by the user's other hand pulling seventh end flap 174. Removal of removable section 206 requires separating only three separation lines, and second, or free, side edge 110 facilitates sliding of bottom wall 226 easily from under products 402, facilitating quick and easy conversion of container 200 into standalone display of products 402.

Figure 6:
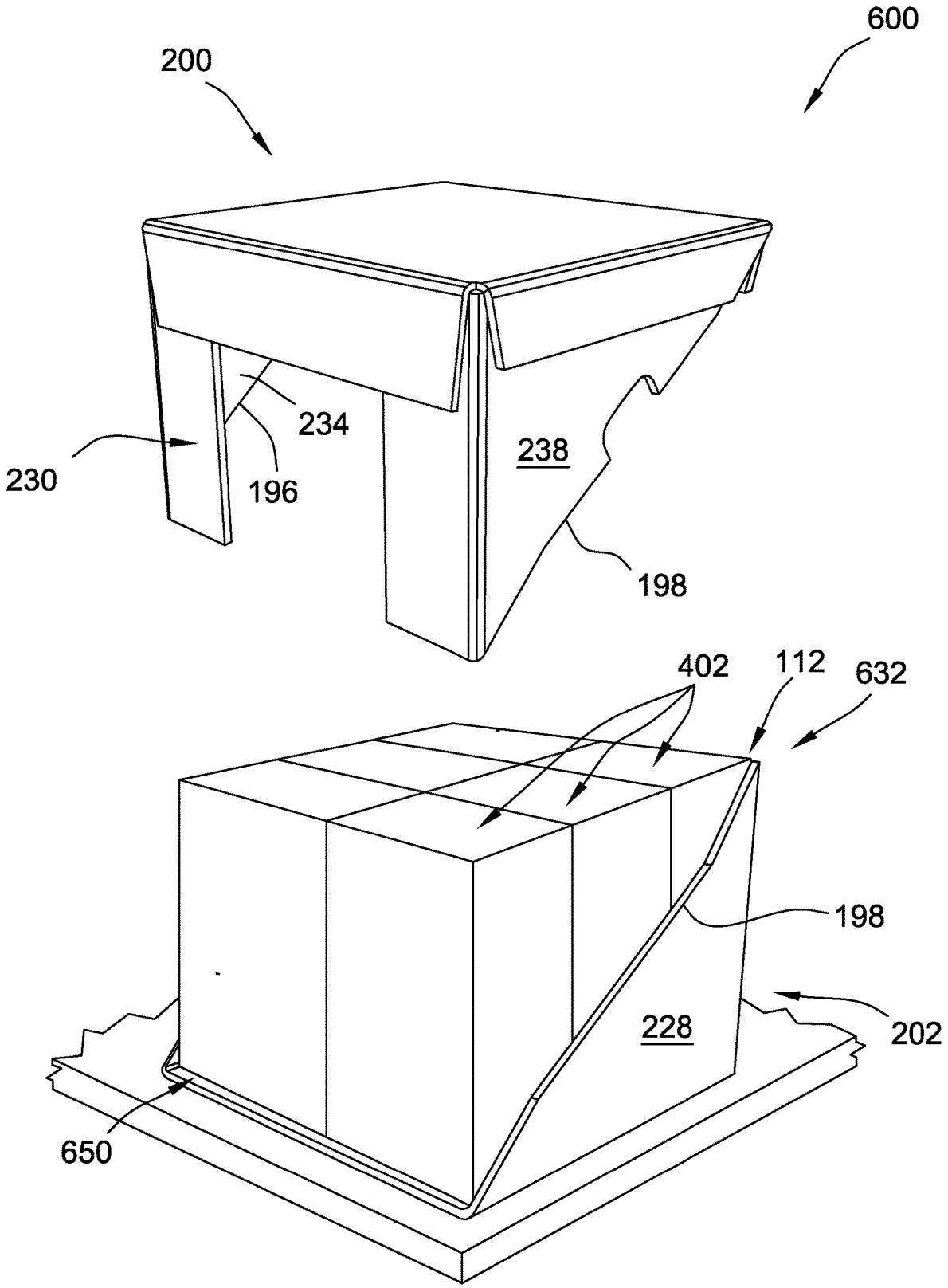
FIG. 6 is a perspective view of the container shown in FIG. 2 in an alternative display configuration.

FIG. 6 illustrates container 200 oriented in an alternative product display configuration 600 in which base 202 may support products 402 for display. In this embodiment, a back wall 632 is formed by second end wall 232 (shown in FIG. 2). To open container 200, removable section 206 is detached from base 202 by separating separation lines 196 and 198, as described above. In addition, fifth end flap 170 is lifted and detached from first and third end flaps 140 and 144, such as by manually breaking an adhesive bond, and removable section 206 is lifted from base 202. After removable section 206 is disengaged from base 202, a display area 650 is visible to consumers to facilitate displaying products 402 supported within base 202. The removal of an entirety of first end wall 230 as part of removable section 206 facilitates display of products 402 in, and removal of products 402 from, base 202. Moreover, second, or free, side edge 110 provides a clean front edge of bottom wall 226 to enhance aesthetics of, and ease of reaching into, display area 650. In addition, removal of removable section 206 again requires separating only two separation lines, facilitating quick and easy conversion of container 200 into product display configuration 600.

In an alternative embodiment, after separation of separation lines 196, 198, and 186 (shown in FIGS. 5A and 5B), base 202 may support products 402 for display. This alternative embodiment is similar to an alternative product display configuration 600. In this embodiment, a back wall, similar to front wall 632, is formed by second end wall 232 (shown in FIG. 2). In this embodiment, the back wall also includes fifth end flap 170. To open container 200, removable section 206 is detached from base 202 by separating separation lines 196, 198, and 186, as described above in FIGS. 5A and 5B. In addition, fifth end flap 170 remains attached to first and third end flaps 140 and 144 to increase stability of base 202. After removable section 206 is disengaged from base 202, a display area 650 is visible to consumers to facilitate displaying products 402 supported within base 202. The removal of an entirety of first end wall 230 as part of removable section 206 facilitates display of products 402 in, and removal of products 402 from, base 202. Moreover, second, or free, side edge 110 provides a clean front edge of bottom wall 226 to enhance aesthetics of, and ease of reaching into, display area 450. In addition, removal of removable section 206 again requires separating only three separation lines, facilitating quick and easy conversion of container 200 into the product display configuration described in this embodiment.

As such, in an embodiment, the following steps are performed to form container 200 from blank 100: (1) separate a first side wall 214 of container 200 along a first separation line 196, wherein a bottom wall 226 includes a free side edge 110 and first separation line 196 extends from proximate free side edge 110 to a diagonally opposite corner of first side wall 214; (2) separate second side wall 218 of container 200 along a second separation line 198, wherein second separation line 198 extends from proximate free side edge 110 to a diagonally opposite corner of second side wall 218, and wherein first and second side walls 214, 218 include respective opposing first and second side edges 160, 164 and 162, 166; and (3) remove a removable portion of container 200 from a base 202 of container 200, wherein the removable portion includes a top wall 222 and a first end wall 230, wherein a second end wall 232 includes a first end flap 140 emanating from first side edge 160 of first side wall 214 and a third end flap 144 emanating from first side edge 164 of second side wall 218, and wherein first end wall 230 includes a second end flap 142 emanating from second side edge 162 of first side wall 214 and a fourth end flap 146 emanating from second side edge 166 of second side wall 218, and first end wall 230 includes second and fourth end flaps 142, 146. In alternative embodiments, steps (1)-(3) are performed in any suitable sequence that enables container 200 to be formed as described herein.

Embodiments of the above-described container are easily constructed from a flexible unitary blank, either manually or using a suitable container-erecting machine, for example by wrapping around a mandrel. Further, embodiments of the above-described container include a removable section that requires separating only two separation lines for removal from a base. The removable section is at least partially defined on the side panels of the container, and does not require additional blank material to be added to the side panels. The container may be oriented in a first orientation, which enables the base to also be easily pulled out from under the products for stand-alone display, or in a second orientation, in which the base remains with side walls and back walls to support the products, but with no front wall such that display and removal of the products is not obstructed.

Example embodiments of a blank and container have been described above in detail. The blank and container are not limited to the specific embodiments described herein, but rather, components of the blank and container and/or steps of the methods of forming the container may be utilized independently and separately from other components and/or steps described herein. Further, the described components and/or method steps can also be defined in, or used in combination with, other apparatus and/or methods, and are not limited to practice with only the apparatus and method as described herein.

While the invention has been described in terms of various specific embodiments, those skilled in the art will recognize that the invention can be practiced with modification within the spirit and scope of the claims.

What is claimed is:

1. A blank for forming a container, the blank comprising:

a top panel, a first side panel, a bottom panel, and a second side panel coupled together in series by a plurality of generally parallel fold lines, wherein the bottom panel includes a free side edge that extends the entire distance between, and abuts, an adjacent two of said plurality of generally parallel fold lines, the first side panel includes a first separation line extending from proximate the free side edge and across at least a portion of the first side panel, and the second side panel includes a second separation line extending from proximate the free side edge and across at least a portion of the second side panel;

a first end flap and a second end flap extending from opposing side edges of the first side panel; and a third end flap and a fourth end flap extending from opposing side edges of the second side panel, wherein the second and fourth end flaps are configured for removal with the top panel after the container is formed and the first and second separation lines are separated.

2. The blank in accordance with claim 1, further comprising a leading edge and an opposite trailing edge in series with the top panel, the first side panel, the bottom panel, and the second side panel, wherein a corrugation direction of the blank is generally parallel to a length of the blank defined between the leading edge and the opposite trailing edge.

3. The blank in accordance with claim 1, further comprising a fifth end flap and a sixth end flap extending from opposing sides of the top panel, wherein the sixth end flap is configured to cooperate with the second and fourth end flaps to form a first end wall when the container is formed, the first end wall removable with the top panel after the first and second separation lines are separated.

4. The blank in accordance with claim 3, further comprising a seventh end flap extending from a first side edge of the bottom panel, the free side edge comprising a second side edge of the bottom panel opposite the first side edge, wherein the first end flap, the third end flap, the fifth end flap, and the seventh end flap are configured to form a second end wall when the container is formed.

5. A blank for forming a container, the blank comprising:

a top panel, a first side panel, a bottom panel, and a second side panel coupled together in series by a plurality of generally parallel fold lines, wherein the bottom panel includes a free side edge, the first side panel includes a first separation line extending from proximate the free side edge and across at least a portion of the first side panel, and the second side panel includes a second separation line extending from proximate the free side edge and across at least a portion of the second side panel;

a first end flap and a second end flap extending from opposing side edges of the first side panel; and a third end flap and a fourth end flap extending from opposing side edges of the second side panel, wherein the second and fourth end flaps are configured for removal with the top panel after the container is formed and the first and second separation lines are separated, wherein all perimeter edges of the top panel, the first side panel, the bottom panel, and the second side panel are substantially devoid of separation lines.

6. The blank in accordance with claim 1, wherein the first, second, third, and fourth end flaps are configured to extend from the bottom panel to the top panel when the container is formed.

7. A container formed from a blank, the container comprising:

opposing top and bottom walls, the bottom wall including a free side edge;

opposing first and second side walls perpendicular to the opposing top and bottom walls, the first and second side walls including respective opposing first and second side edges, wherein the first side wall further includes a first separation line extending from proximate the free side edge and across at least a portion of the first side wall, and the second side wall further includes a second separation line extending from proximate the free side edge and across at least a portion of the second side wall; and opposing first and second end walls perpendicular to the opposing top and bottom walls and perpendicular to the opposing first and second walls, wherein:

the second end wall includes a first end flap emanating from the first side edge of the first side wall and a third end flap emanating from the first side edge of the second side wall, the first end wall includes a second end flap emanating from the second side edge of the first side wall and a fourth end flap emanating from the second side edge of the second side wall, and the first end wall is removable with the top wall after the first and second separation lines are separated, wherein said free side edge of the bottom wall extends the entire distance between, and abuts, said opposing first and second side walls.

8. The container according to claim 7, wherein a corrugation direction of the first, second, third, and fourth end flaps is generally parallel to the opposing first and second side edges of the first and second side walls.

9. The container according to claim 7, wherein the top wall includes opposing first and second side edges, the second end wall further includes a fifth end flap emanating from the first side edge of the top wall, and the first end wall further includes a sixth end flap emanating from the second side edge of the top wall.

10. The container according to claim 7, wherein the bottom wall includes opposing first and second side edges, the free side edge is the second side edge of the bottom wall, and the second end wall further includes a seventh end flap emanating from the first side edge of the bottom wall.

11. A container formed from a blank, the container comprising:

opposing top and bottom walls, the bottom wall including a free side edge;

opposing first and second side walls perpendicular to the opposing top and bottom walls, the first and second side walls including respective opposing first, and second side edges, wherein the first side wall further includes a first separation line extending from proximate the free side edge and across at least a portion of the first side wall, and the second side wall further includes a second separation line extending from proximate the free side edge and across at least a portion of the second side wall; and opposing first and second end walls perpendicular to the opposing top and bottom walls and perpendicular to the opposing first and second walls, wherein:

the second end wall includes a first end flap emanating from the first side edge of the first side wall and a third end flap emanating from the first side edge of the second side wall, the first end wall includes a second end flap emanating from the second side edge of the first side wall and a fourth end flap emanating from the second side edge of the second side wall, and the first end wall is removable with the top wall after the first and second separation lines are separated, wherein all perimeter edges of the top wall, the first side wall, the bottom wall, and the second side wall are substantially devoid of separation lines.

12. The container according to claim 7, wherein the first, second, third, and fourth end flaps extend from the bottom wall to the top wall.

* * * * *